US006036174A

United States Patent [19]

Andersen

[11] Patent Number: 6,036,174

[45] Date of Patent: Mar. 14, 2000

[54] DUAL SPEED WINCH USING ONE-WAY CLUTCHES OPERATING IN OPPOSITE DIRECTIONS

[75] Inventor: Frode Andersen, Vejle, Denmark

[73] Assignee: Fr. Andersens Maskinfabrik A/S, Vejle, Denmark

[21] Appl. No.: 09/117,290

[22] PCT Filed: Feb. 27, 1997

[86] PCT No.: PCT/DK97/00088

§ 371 Date: Aug. 26, 1998

§ 102(e) Date: Aug. 26, 1998

[87] PCT Pub. No.: WO97/31856

PCT Pub. Date: Sep. 4, 1997

[30] Foreign Application Priority Data

Feb. 27, 1996 [DK] Denmark ..... 0215/96

[51] Int. Cl.[7] ..... B66D 1/14

[52] U.S. Cl. ..... 254/343; 74/416; 74/665 H; 74/724

[58] Field of Search ..... 254/343, 344; 74/665 R, 665 F, 665 H, 724, 412 R, 416

[56] References Cited

U.S. PATENT DOCUMENTS

| | | | |
|---|---|---|---|
| Re. 30,423 | 10/1980 | Hutton et al. | 254/344 X |
| 3,600,977 | 8/1971 | Bogie | 254/344 X |
| 3,712,155 | 1/1973 | Stommel et al. | 254/344 X |
| 3,728,914 | 4/1973 | Guangorena et al. . | |
| 3,799,005 | 3/1974 | Koehler | 254/344 X |
| 3,942,762 | 3/1976 | Reymond | 254/344 |
| 3,998,431 | 12/1976 | Fawcett | 254/343 |

FOREIGN PATENT DOCUMENTS

| | | |
|---|---|---|
| 2 276 137 | 9/1994 | United Kingdom . |
| WO 88/06565 | 9/1988 | WIPO . |

*Primary Examiner*—Donald P. Walsh
*Assistant Examiner*—Emmanuel M. Marcelo
*Attorney, Agent, or Firm*—Sixbey, Friedman, Leedom & Ferguson; David S. Safran

[57] ABSTRACT

For some powered drum winches, e.g. in sailing boats, it is desirable that the drum can be driven with two different speeds. Basically, this is no technical problem, but it has been difficult to achieve both a high efficiency and a simple construction. It has been proposed that with the use of a plural shaft gear an advantageous result is obtainable in making the gear drive the drum with two different speeds based on a reversible driving motor being driven in one or the opposite direction. This control principle is also used in the present connection in which, however, it is disclosed how the relevant gear can be designed in a compact and inexpensive manner about only a single gear shaft.

2 Claims, 1 Drawing Sheet

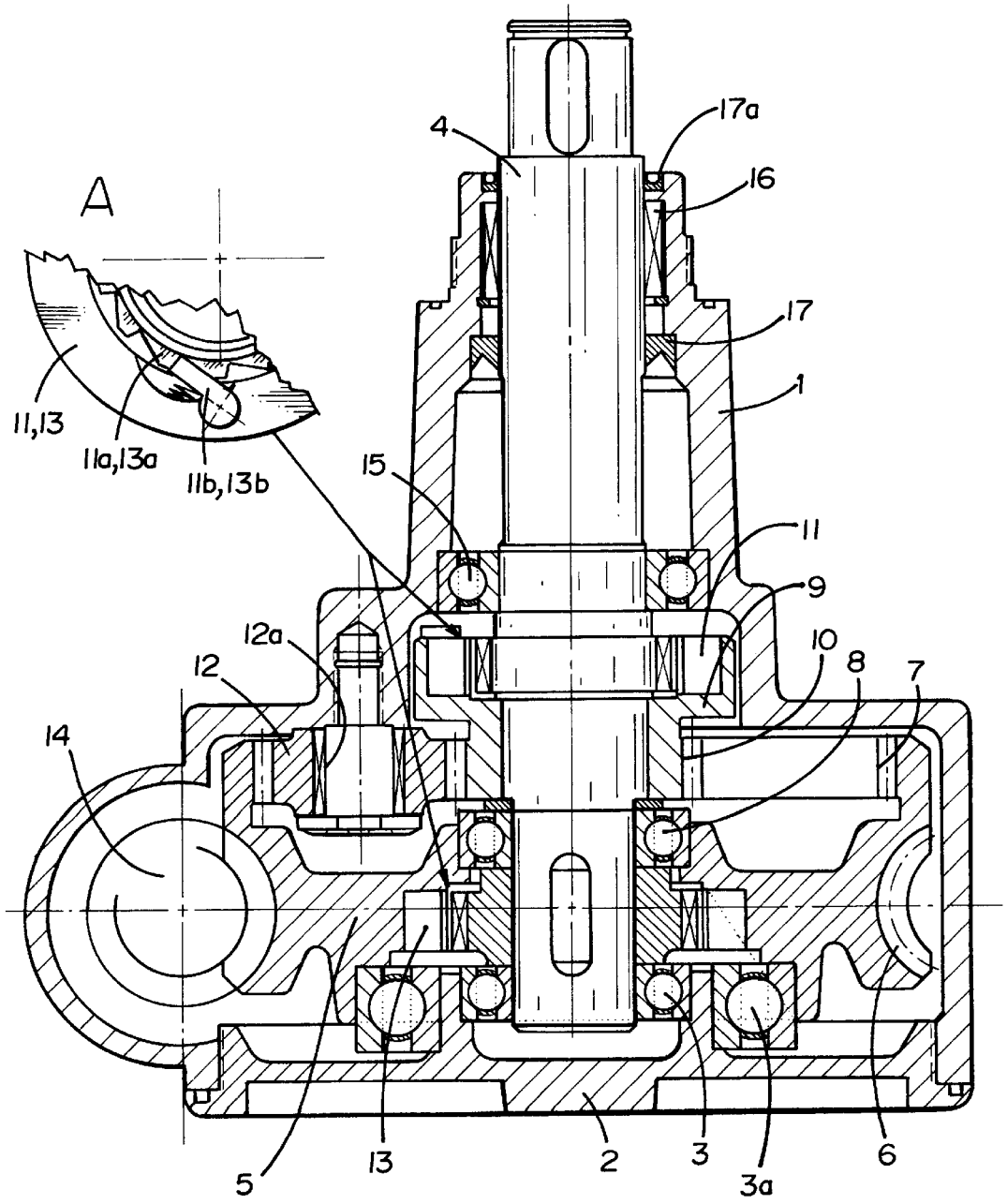
A
11,13
11a,13a
11b,13b
4
17a
16
17
1
15
11
9
10
8
7
12a
12
14
5
13
2
3
3a
6

DUAL SPEED WINCH USING ONE-WAY CLUTCHES OPERATING IN OPPOSITE DIRECTIONS

BACKGROUND OF THE INVENTION

1. Field of the Invention

The present invention concerns a powered winch, especially for sail boats, i.e. a winch with a drum which in the winding direction may be driven with two different speeds by means of a relatively simple gear mechanism which reacts to the two different ways depending on the direction of rotation of the used reversible motor without any special readjustment means.

2. Description of Related Art

In published British Patent Application GB-A-2,276,137 it is known that this result is achieved by letting the motor drive a driving shaft carrying a large and a small gear wheel, in that between the driving shaft and the large gear wheel there is inserted a gear wheel hub arranged as a one-way clutch. The large gear wheel is driving an even larger gear wheel on an output shaft also carrying a lesser gear wheel, which is driving an internal tooth rim on the winch drum. Thereby, in one direction of rotation of the motor, a direct driving connection between the driving shaft and the output shaft will be established, while this connection is passive in the opposite direction of rotation of the motor and thereby of the driving shaft.

The small gear wheel on the driving shaft is in permanent engagement with a larger gear wheel on an intermediate shaft, which also carries a lesser gear wheel having a permanent driving connection to the large gear wheel on the output shaft. The larger gear wheel on the intermediate shaft has a hub part in form of a one-way clutch giving free wheel at the said only direction of rotation of the driving shaft while the clutch is engaged in the opposite direction of rotation where the said direct drive will be disengaged. In the opposite direction of rotation the transmission will thus take place through the intermediate shaft with an appreciably lower gear ratio and with a shift of the direction of rotation, so that the output shaft will turn in the same direction in spite of the change of the rotational direction, now only with a lower rpm.

SUMMARY OF THE INVENTION

By the invention there is achieved a similar effect as with the above-described prior art, but with a considerably simplified gear arrangement.

By the invention it has been realized, that this construction may be arranged in the simple way as indicated below, in that the driving and output shaft hereby acts as the same element, while the intermediate shaft is reduced to an axle journal only supporting a single gear wheel and which as a whole is situated internally between the main shaft in question and the periphery of the large gear wheel on the driving shaft. This gives the possibility of a very compact design of the whole gear arrangement in the winch, something which is essential with regard to economy and need for space.

By using winches with one-way clutches it will be achieved that the winch drum may be accelerated quickly and rotated without noticeable friction as the mass of shafts and gear wheels in permanent driving connection with the drum is reduced considerably. It is suitable to utilize such a free wheel when manually hauling a slack rope before use is made of the motor winch.

BRIEF DESCRIPTION OF THE DRAWINGS

The invention is explained in more detail in the following with reference to the drawing, which shows an elevated section of the gear in a winch according to the invention.

DETAILED DESCRIPTION OF THE INVENTION

The FIGURE shows a housing 1 closed at the bottom with a precisely adapted bottom 2 which among others may contain fastening means. At the same time the bottom functions as basis for the fixed part of two roller bearings, an inner bearing 3 constituting a bottom bearing for a through-going shaft 4, and an outer bearing 3*a* constituting a main bearing for a specially shaped gear wheel 5. This bearing has a helically cut tooth gearing 6 outwardly on the periphery and an internal tooth gearing 7. The gear wheel is furthermore connected with the through-going shaft 4 by a further roller bearing 8. On the shaft 4 there is provided a rotatable bushing 9 having a tooth gearing 10 at the bottom and a one-way clutch 11 at the top, which can establish engagement with the shaft 4 only in one direction of rotation around the shaft. This function is established by the outer part being in one part with the bushing 9 having springloaded pawls 11*b* which at the said direction of rotation catch a toothed rim 11*a* rotationally connected with the shaft 4. In the inserted horizontal section A it is shown how this arrangement is working.

Inside and engaged with the internal tooth gearing 7 there is provided an intermediate gear wheel 12 which is also engaged with the tooth gearing 10. The intermediate wheel 12 is supported by means of a roller bearing 12*a* on a pivot fastened in the housing 1. The gear wheel 5 is at one direction of rotation between the bearing 3 and 8 connected with the shaft 4, since there is provided a further one-way clutch 13, which only establishes connection with the shaft 4 in one direction of rotation about the shaft. This function is established in that the outer part, being one part with the gear wheel 5, has springloaded pawls 13*b* which in one direction of rotation catch a toothed rim 13*a* rotationally connected with the shaft 4. By the inserted horizontal section A it is shown how this arrangement is functioning. The direction of rotation for the engagement is the same as for the one-way clutch 11. The shaft 4 is also supported by further roller bearings 15 and 16 and provided with sealing means 17, 17*a*. The external helically cut toothing is in permanent engagement with a worm 14, the shaft of which is perpendicular to the shaft 4. This worm is supported in the housing 1, and necessary sealing means are provided.

The upper end of the shaft 4 constitutes a power output, which due to the arrangement with an intermediate wheel 12 and two one-way clutches 11 and 13 always will be driven in the same direction irrespectively of the direction of rotation of the worm 14. However, there will be differences with respect to the speed of rotation, because rotation in one direction will result in a direct drive from the gear wheel 5 to the output shaft 4, while rotation in the other direction will result in an increase in the rpm relatively to the number of teeth of the internal tooth gearing 7 and the tooth gearing 10 on the bushing 9. A change of the gear ratio may be performed at the constructional stage by changing the number of teeth. Thereby, possibility of alteration of the speed is achieved in a very compact arrangement.

By quickly manually hauling a slack rope already wound a couple of times around the drum, this will be able to turn only carrying with it the shaft 4, and thus without meeting resistance from the used gear wheels; these are to be accelerated to speed when the rope is tight, and when the winch motor is activated.

It is to be mentioned that the gear wheel 7 does not have to be driven by a worm gear. It may very well be driven in other ways, e.g. with a crown wheel/bevel pinion drive.

The invention is not limited for use with drums directly mounted on the output shaft, but may very well be used in connection with a drum which is independently supported and turned at the bottom, for example with a chain from the gearing.

I claim:

1. A powered winch for driving a drum at two different speeds in a single winding direction, comprising:

a driving gear wheel mounted on a main output shaft, said driving gear wheel being mounted to rotate in each of opposite rotational directions, having an external toothing on an outer rim and having an internal toothing on an inner rim, said inner rim being mounted on a flange which protrudes from said gear wheel in an axial direction;

a drive member in driving engagement with the external toothing of said driving gear wheel, said drive member being displaceable in each of opposite driving directions for rotating the driving gear wheel in said opposite rotational directions;

a first one-way clutch acting between said driving gear wheel and said main output shaft;

an intermediate gear wheel in driven engagement with the internal toothing of said driving gear wheel and being driven in an opposite rotational direction relative to said driving gear wheel in response to driving of said driving gear wheel by said drive member;

a toothed bushing mounted on said main output shaft; and a second one-way clutch acting between said intermediate gear wheel and said toothed bushing;

wherein, in a first of said opposite driving directions of said drive member, a driving connection having a first gear ratio is produced between said driving gear wheel and said main output shaft by said first one-way clutch for driving said main output shaft at a first of said two different speeds in the same direction, said second one-way clutch being disengaged; and wherein, in a second of said opposite driving directions of said drive member, a driving connection having a second gear ratio is produced between said intermediate gear wheel and said toothed bushing by said second one-way clutch for driving said main output shaft at a second of said two different speeds in the same direction, said first one-way clutch being disengaged.

2. A powered winch according to claim 1, wherein said drive member is a worm drive member; and wherein said external toothing comprises worm drive teeth for cooperating with said worm drive member.

* * * * *